US005820390A

United States Patent [19]

Takamoto et al.

[11] Patent Number: 5,820,390

[45] Date of Patent: Oct. 13, 1998

[54] SUBSTRATE MOUNTED CONNECTOR ASSEMBLY FOR INTERCONNECTING EXTERNAL CIRCUITS AND THE SUBSTRATE

[75] Inventors: Junji Takamoto, Kyoto-fu; Takashi Futatsugi, Kanagawa-ken; Shinichi Hashimoto, Kanagawa-ken; Ikuo Enomoto, Kanagawa-ken, all of Japan

[73] Assignee: Nintendo Co., Ltd., Kyoto, Japan

[21] Appl. No.: 665,633

[22] Filed: Jun. 18, 1996

[51] Int. Cl.[6] ..... H01R 9/09

[52] U.S. Cl. ..... 439/78; 439/607

[58] Field of Search ..... 439/74, 78, 81, 439/83, 108, 607, 609, 660

[56] References Cited

U.S. PATENT DOCUMENTS

| | | | |
|---|---|---|---|
| 5,006,080 | 4/1991 | Ichitsubo et al. | 439/634 |
| 5,176,526 | 1/1993 | Hillbish et al. | 439/74 |
| 5,316,487 | 5/1994 | Clark | 439/78 |

FOREIGN PATENT DOCUMENTS

| | | |
|---|---|---|
| 0417 899 A1 | 1/1990 | European Pat. Off. . |
| 62-163278 | 7/1987 | Japan . |
| 6-35418 | 9/1994 | Japan . |

*Primary Examiner*—Neil Abrams
*Assistant Examiner*—Barry M. L. Standig
*Attorney, Agent, or Firm*—Nixon & Vanderhye P.C.

[57] ABSTRACT

A first connector 30 mounted on an upper surface of a substrate 10 has a first contact 38 which contacts with a card 32 inserted from one end and extends through a through hole 22 of the substrate 10 at the other end. The first contact 38 is supported by the first connector 30 in a distant position from the substrate 10, and a connecting portion 38*c* thereof and the through hole 22 are spaced apart. A second connector 60 has a second contact 66 which contacts with an external connector 90 inserted from one end and the connecting portion 38*c* of the first contact 38 inserted from the other end. The substrate 10, the first and second connectors 30 and 60 are connected each other by connection between the connecting portion 38*c* and a spring 66*c*.

The first and second connectors 30 and 60 include shield shells 40 and 68 covering the first and second connectors 30 and 60, respectively, and the shield shells 40 and 68 are maintained in the same electric potential through a ground electrode of the substrate 10 to effectively prevent unwanted emission caused by a ground potential difference between connectors.

8 Claims, 4 Drawing Sheets

SUBSTRATE MOUNTED CONNECTOR ASSEMBLY FOR INTERCONNECTING EXTERNAL CIRCUITS AND THE SUBSTRATE

BACKGROUND OF THE INVENTION

1. Field of the Invention

This invention relates to connector assemblies, and more specifically to a connector assembly including a substrate and connectors connected to external circuits provided on both sides of the substrate.

2. Description of the Background Art

Connectors which are mounted on a substrate to interconnect an external circuit and the substrate have been widely used. FIG. 4 is a cross-sectional view showing a typical example of such connector and substrate disclosed in Japanese Utility Model Publication No. 6-35418 (corresponding to U.S. Pat. No. 5,006,080). In FIG. 4, the connector is formed of a card edge connector 100 accepting a substrate 120 of a video game cassette which is an external circuit from one end, and an on-board connector 110 interconnecting the card edge connector 100 and a substrate 130. The substrate 120 is connected to the substrate 130 through a contact 102 of the card edge connector 100 and a contact 112 of the on-board connector 110. The contact 102 of the card edge connector 100 is not soldered to the substrate 130. Therefore, when the contact 102 is abraded by insertion and extraction of the substrate 120 in a number of times, it is advantageously easy to change the card edge connector 100.

The above connector, however, has only a function of interconnecting between the two substrates 120 and 130. Therefore, for example, to connect between an external circuit such as an extension unit and the substrate 130, it is required to provide a third connector on the substrate 130. Installation of the third connector is not desirable because an occupied area on the substrate 130 and a component count increase.

On the other hand, Japanese Patent Laying-Open No. 6-2163278 discloses a connector assembly which mounts connectors connectable with external connectors on both sides of a substrate and interconnects between each connector and the substrate. FIG. 5 is an exploded perspective view of such connector assembly. In FIG. 5, the connector assembly includes a substrate 230, a connector 220 mounted on the upper surface side of the substrate 230, a connector 250 mounted on the lower surface side of the substrate 230, and a contact pin 210. The contact pin 210 integratedly has an elastic portion 216 which makes an elastic contact with a conductive layer 234 on the surface of a through hole 232 on the substrate 230, and male contact portions 212 and 214 with respect to the connectors 220 and 250, respectively. Each of the connectors 220 and 250 is connectable to a connector (not shown) which connects the end of the external circuit, and thus it can be advantageously achieved to commonly interconnect two external circuits and the substrate with a rather small component count and without increasing an occupied area on the substrate.

In the above connector assembly, however, it is assumed that the substrate 230 has more than a predetermined board width in which the elastic portion 216 of the contact pin 210 can be pressed. Some substrates, however, do not have an enough board width preferable for being pressed. Furthermore, since many contact pins 210 are pressed in the substrate 230, when the contact portion 212 is abraded, the connector 220 cannot be easily changed.

Moreover, although in the above connector assembly only the single contact pin 210 is required because each of the connectors 220 and 250 on both surfaces of the substrate 230 has male contact portions 214 and 212, respectively, one contact portion cannot pass through the through hole when both contact portions are female contact portions or elastic contact portions. Therefore, terminals of the two connectors 220 and 250 have to be formed separately and interconnected to each other. However, when one terminal is pressed in or soldered to the substrate to be protruded through the opposite side of the substrate, and the protruded end is connected to a female contact portion of the other terminal, if the connected portion is close to the substrate, an installation error etc. of two connectors to the substrate cannot be absorbed, making it difficult to connect two terminals. On the other hand, if the connected portion is far from the substrate, the connector having the other terminal becomes bulky, making it difficult to be downsized.

SUMMARY OF THE INVENTION

Therefore, it is an object of the present invention, in view of the above problems, to provide a connector assembly capable of easily mounting connectors on both sides of a substrate and easily changing one connector.

The present invention has the following characteristics to attain the above object.

The present invention is a connector assembly comprising a first connector mounted on one surface of a substrate and a second connector mounted on the other surface of the substrate, the substrate, the first and second connectors interconnected, wherein the first connector comprises a first contact protruding through a side of the other surface with a space from a through hole of the substrate and being supported by a housing of the first connector in a position spaced apart from the substrate; and the second connector comprises a second contact having a connecting portion connected to the substrate, a contact portion connected to an external connector and an elastic contact portion provided between the connecting portion and the contact portion and contacted with the first contact.

According to the present invention described above, a connector assembly can be obtained capable of easily mounting the first and second connectors on the substrate without limitation of a board width of the substrate etc., and easily changing the first connector.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
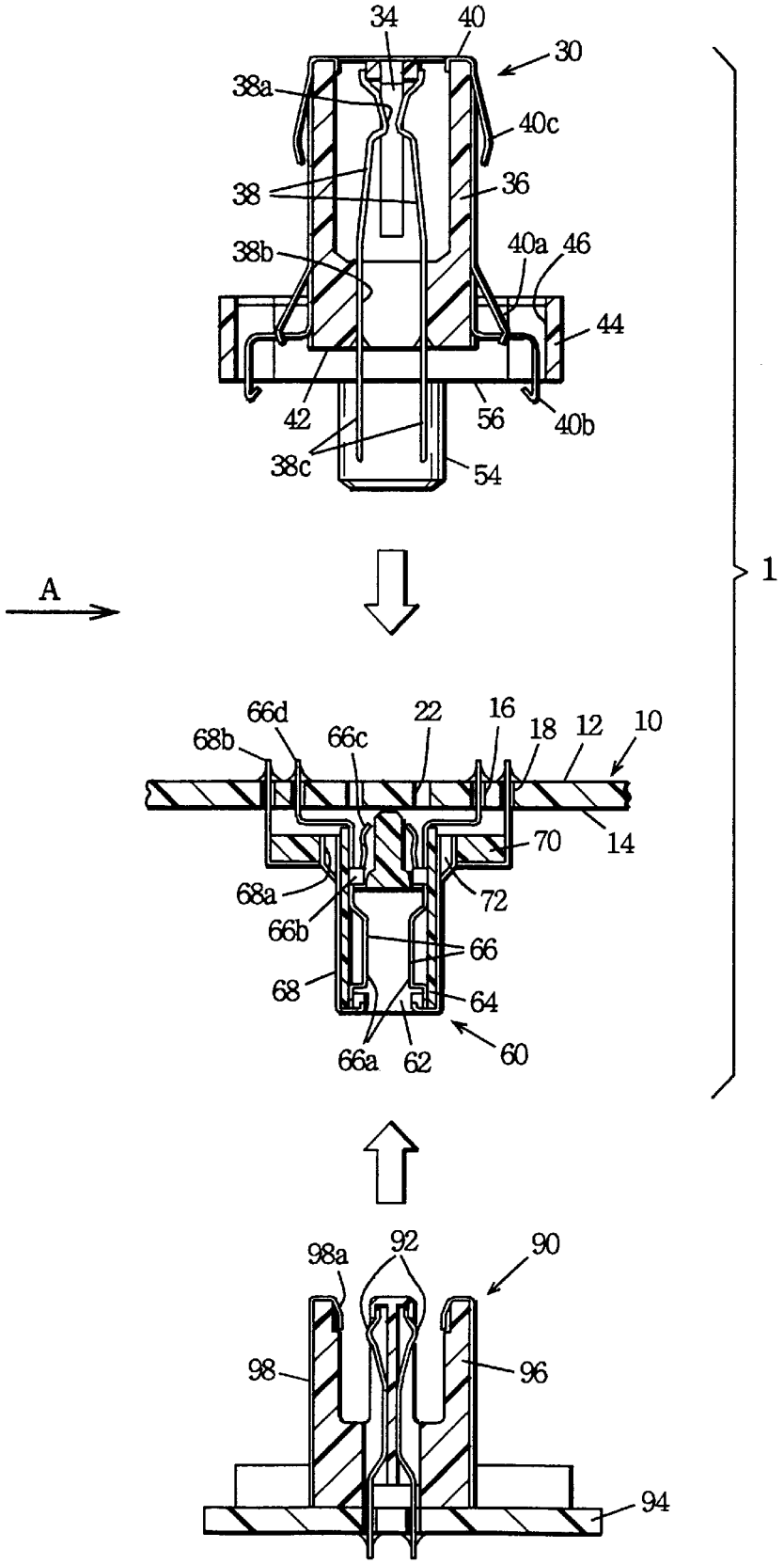
FIG. 1 is an exploded cross-sectional view of a connector assembly according to an embodiment of the present invention.
Figure 2:
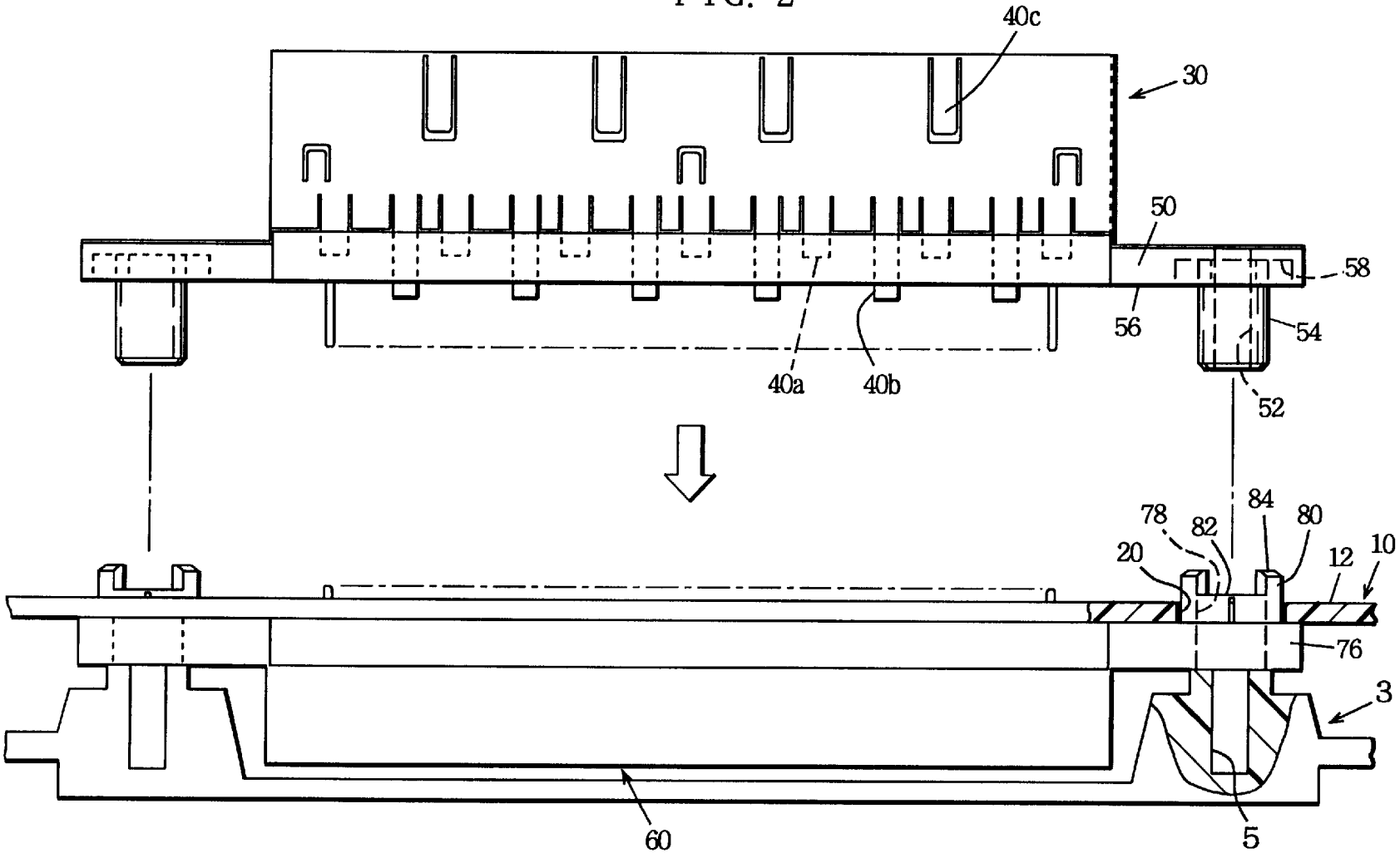
FIG. 2 is a diagram of the connector assembly in FIG. 1 seen from an arrow A direction.
Figure 3:
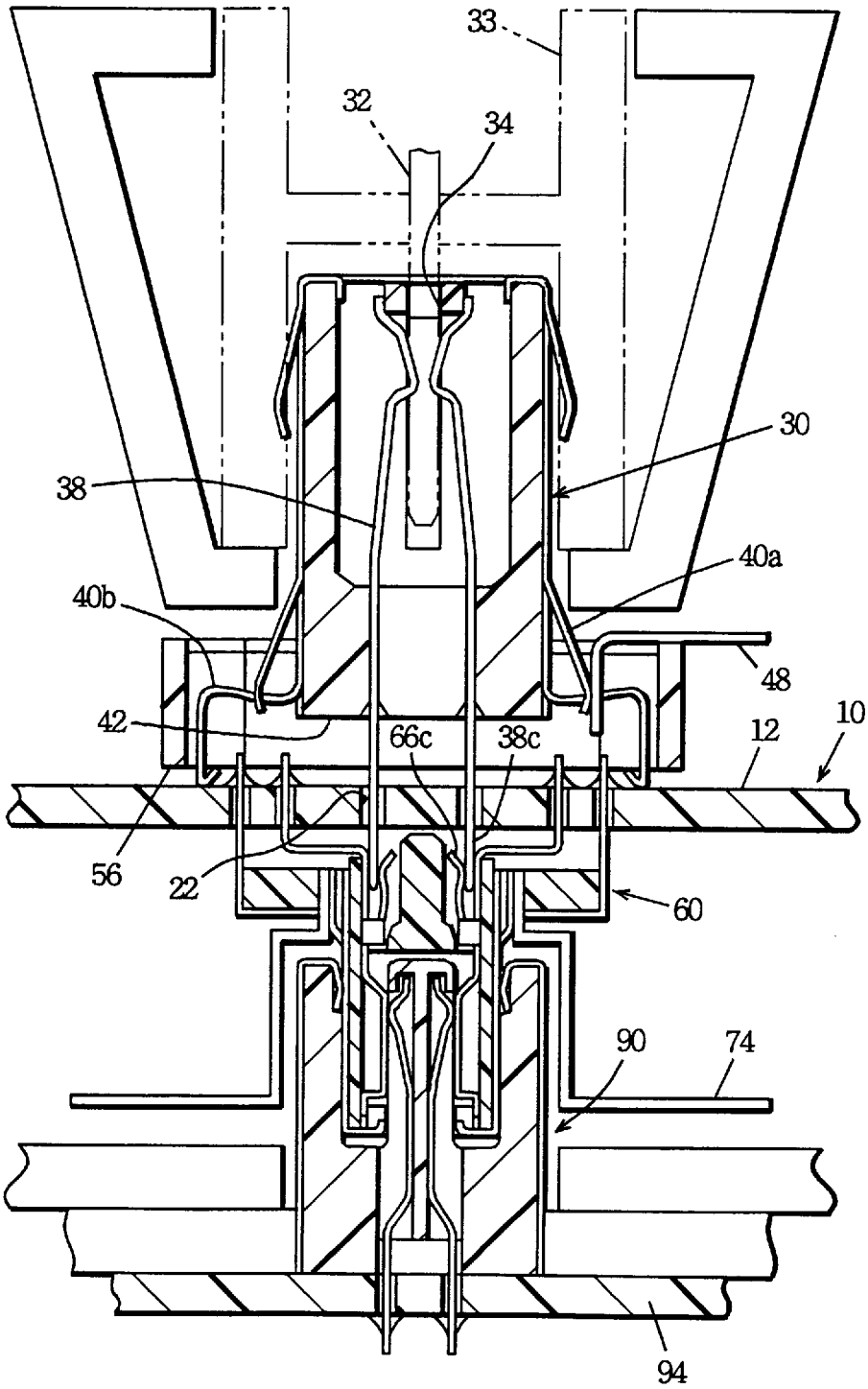
FIG. 3 is a cross-sectional view in a state of assembly of the connector assembly in FIG. 1.
Figure 4:
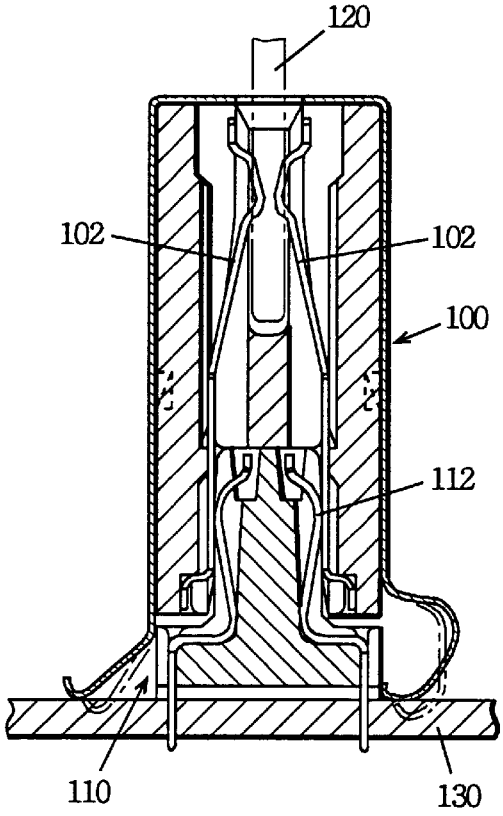
FIG. 4 PRIOR ART
FIG. 4 is a cross-sectional view of a conventional connector.
Figure 5:
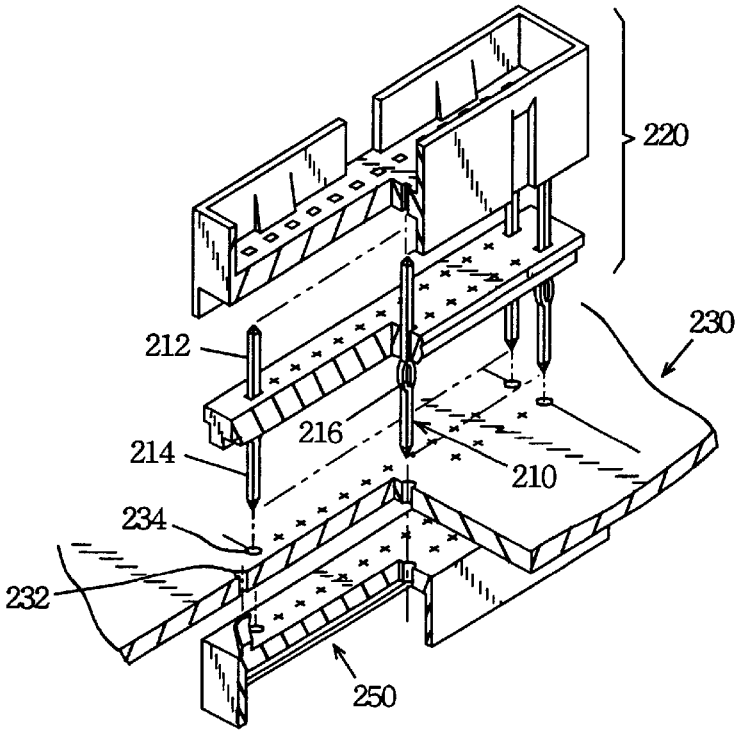
FIG. 5 PRIOR ART
FIG. 5 is an exploded cross-sectional view of a conventional connector assembly.

A preferred embodiment of a connector assembly of the present invention is subsequently described referring to the drawings. FIG. 1 is an exploded cross-sectional view of a connector assembly according to an embodiment of the present invention. FIG. 2 is a diagram of the connector assembly in FIG. 1 seen from an arrow A direction. FIG. 3 is a cross-sectional view in a state of assembly of the connector assembly in FIG. 1.

In FIG. 1, a connector assembly 1 includes a substrate 10, a card edge connector (a first connector) 30 which is mounted on a side of an upper surface 12 of the substrate 10 and a relay connector (a second connector) 60 which is installed on a side of a lower surface 14 of the substrate 10. The card edge connector 30 has an insulating housing 36 having in the middle thereof a slot 34 which accepts a card 32 (refer to FIG. 3), opposed contacts (first contacts) 38 in two rows with respect to a slot 34 and a shield shell 40 covering the insulating housing 36. Each contact 38 has a bent contact portion 38*a* contacting with the card 32, a press portion 38*b* pressed and fixed to the insulating housing 36 and tine portion 38*c* protruding from a bottom surface 42 of the insulating housing 36. An aperture 46 is formed on a first flange 44 of the insulating housing 36, and a first spring 40*a* of the shield shell 40 elastically contacts with a shield 48 (refer to FIG. 3) of a device (not shown) which accommodates the connector assembly 1 in the aperture 46. The shield shell 40 has a second spring 40*b* grounded on the upper surface 12 of the substrate 10 and a third spring 40*c* grounded on a cassette 33 (refer to FIG. 3) which accommodates the card 32.

The relay connector (the second connector) 60 has an insulating housing 64 having an engaging concave portion 62 which accepts an engaging portion of an external connector 90 accommodated in an extension unit etc., opposed contacts (second contacts) 66 in two rows in the engaging concave portion 62 and a shield shell 68 covering the insulating housing 64. Each contact 66 has a contact portion 66*a* contacting with a contact 92 of the external connector 90, a press portion 66*b* bent in a U-shape, a spring (elastic contact portion) 66*c* extending from an end of the press portion 66*b* and tine portion 66*d* which extends from the press portion 66*b* in a crank shape and is soldered to a through hole 16 of the substrate 10. An aperture 72 which accepts a spring 68*a* of the shield shell 68 is formed on a first flange 70 of the insulating housing 64. The spring 68*a* elastically contacts with a lower side shield 74 (refer to FIG. 3) of the device which accommodates the connector assembly 1 in the aperture 72. The shield shell 68 has a tine portion 68*b* which is soldered to a through hole 18 of the substrate 10. Assuming that a foreign substance such as a finger approaches the engaging concave portion 62, it is designed that a distance between the foreign substance and the shield shell 68 be always smaller than a distance between the foreign substance and the contact 66 so that static electricity born by the foreign substance can be discharged to the shield shell 68, not to the contact 66.

The external connector 90 is mounted on a substrate 94 in the extension unit, for example, and has an insulating housing 96, contacts 92 in two rows and a shield shell 98. When engaging the relay connector 60, a spring 98*a* of the shield shell 98 elastically contacts with the shield shell 68 of the relay connector 60.

In FIG. 2, a boss 80 having an opening 78 protrudes on a second flange 76 of the relay connector 60 and is accepted in an opening 20 of the substrate 10. A boss 54 having an opening 52 protrudes on a second flange 50 of the card edge connector 30 and is accepted in the opening 78 of the boss 80 in the relay connector 60.

An assembling process of the connector assembly 1 is subsequently described. First, the relay connector 60 is mounted on the substrate 10, and the tine portions 66*d* and 68*b* of the contact 66 and the shield shell 68, respectively, are soldered to the substrate 10. Next, the relay connector 60 fixed to the substrate 10 is mounted on a housing 3, and then the card edge connector 30 is mounted thereon. In this situation, a bottom surface 56 of the second flange 50 of the card edge connector 30 abuts on a step portion 82 of the boss 80 in the relay connector 60 which is in a higher level than a board width of the substrate 10. Therefore, the bottom surface 56 of the card edge connector 30 does not abut on the upper surface 12 of the substrate 10 so as to prevent a poor connection due to warpage of the substrate 10 etc. A convex portion 84 of the boss 80 is accepted in a concave portion 58 adjacent to the boss 54. Next, the card edge connector 30 is fixed to the housing 3 with the substrate 10 and the relay connector 60 by a screw (not shown) which self-taps a hole 5 of the resin-made housing 3.

In FIG. 3, the tine portion 38*c* of the contact 38 of the card edge connector 30 contacts with the spring 66*c* of the contact 66 in the relay connector 60 through a through hole 22 of the substrate 10, being spaced apart from the through hole 22. Furthermore, the tine portion 38*c* protrudes from a bottom surface 42 spaced apart from the bottom surface 56 of the second flange 50. Therefore, since the tine portion 38*c* has a predetermined elasticity, even if a poor connection of the connectors 30 and 60 to the substrate 10 occurs, the tine portion 38*c* can reliably make contact with the spring 66*c* of the relay connector 60. Furthermore, if a difference of a coefficient of thermal expansion occurs among the substrate 10, the card edge connector housing 36 and the relay connector housing 64, the connection between the card edge connector 30 and the relay connector 60 is maintained. Moreover, when the card edge connector 30 needs to be changed because the contact 38 of the card edge connector 30 is abraded by insertion and extraction of the card 32 in a number of times, the change can be easily made since the card edge connector 30 is not soldered to the substrate 10.

Since the shield shells 40 and 68 are installed in the card edge connector 30 and the relay connector 60, respectively, it is possible to keep the same ground electric potential of both connectors 30 and 60, resulting in the prevention of unwanted emission due to the ground electric potential difference between the connectors 30 and 60.

Furthermore, since the connectors 30 and 60 respectively have the springs 40*a*, 40*b* and 68*a*, 68*b* which elastically contact with the shields 48 and 74 of the device which accommodates the substrate 10 and the connector assembly 1, it is possible to keep the same ground electric potential of the entire device, resulting in the prevention of unwanted emission in the entire device.

Furthermore, since the spring 40*c* is grounded on a shield of the cassette 33 and the shield shell 68 is grounded on the spring 98*a* of the external connector 90, it is possible to keep the same ground electric potential of the entire device not only when only the device is used but also when the cassette 33 and the external connector 90 are connected to the device, resulting in the prevention of unwanted emission in the entire system.

Although the preferred embodiment of the present invention is described as above, the present invention is not restricted to the above embodiment, and variants and various changes can be made as required. For example, the contact of each connector may be a male contact portion instead of a contact portion having elasticity. Further, the tine portions 66*d* and 68*b* of the contact 66 and the shield shell 68 of the relay connector 60 may be of a surface-mounting type.

Further, while the relay connector 60 accepts the engaging portion of the external connector 90 in the above embodiment, the external connector 90 may conversely accept the engaging portion of the relay connecter 60.

While the invention has been described in detail, the foregoing description is in all aspects illustrative and not restrictive. It is understood that numerous other modifications and variations can be devised without departing from the scope of the invention.

What is claimed is:

1. A connector assembly comprising a first connector mounted on one surface of a substrate and a second connector mounted on another surface of the substrate, the substrate, the first and second connectors being interconnected, wherein said first connector comprises a first housing having an abutting portion which abuts said substrate at a mounting portion formed on said substrate for mounting the first connector, and a facing area which is spaced from the substrate and faces the substrate, and a first contact protruding from said facing area and supported by said first housing, said first contact protruding through a side of said other surface with a space from a through hole of said substrate, said first connector further comprising a first shield shell covering the first connector, said first shield shell comprising a first spring grounded on a ground electrode formed on said substrate; and wherein said second connector comprises a second housing and a second contact being supported by said second housing and having a connecting portion connected to said substrate, a contact portion connected to an external connector and an elastic contact portion provided between the connecting portion and the contact portion and contacted with said first contact, said second connector further comprising a second shield shell covering the connector, said second shield shell comprising a tine portion electrically connected to the ground electrode formed on said substrate; and wherein the ground electric potential of the first and second connectors is maintained at the same electric potential through the substrate.

2. The connector assembly according to claim 1, wherein said first shield shell comprises a second spring connected to a shield of a device which accommodates said connector assembly;

said second shield shell comprises a spring grounded on said shield; and ground electric potential of the entire connector assembly is held the same.

3. The connector assembly according to claim 1, wherein said first shield shell comprises a third spring connected to a shield shell of an external circuit installed into said first connector.

4. The connector assembly according to claim 1, wherein said second shield shell is connected to a shield shell installed into said external connector.

5. A connector assembly comprising a first connector mounted on one surface of a substrate and a second connector mounted on another surface of the substrate, the substrate, the first and second connectors being interconnected, wherein said first connector comprises a first contact protruding through a side of said other surface with a space from a through hole of said substrate and being supported by a housing of the first connector in a position spaced apart from said substrate, said first connector further comprising a first shield shell covering the first connector; and said first shield shell comprising a first spring grounded on a ground electrode formed on said substrate;

said second connector comprises a second contact having a connecting portion connected to said substrate, a contact portion connected to an external connector and an elastic contact portion provided between the connecting portion and the contact portion and contacted with said first contact;

said second connector further comprising a second shield shell covering the second connector;

said second shield shell comprising a tine portion electrically connected to the ground electrode formed on said substrate; and wherein the ground electric potential of the first and second connectors is maintained at the same electric potential through the substrate.

6. The connector assembly according to claim 5, wherein said first shield shell comprises a second spring connected to a shield of a device which accommodates said connector assembly;

said second shield shell comprises a spring grounded on said shield; and ground electric potential of the entire connector assembly is held the same.

7. The connector assembly according to claim 5, wherein said first shield shell comprises a third spring connected to a shield shell of an external circuit installed into said first connector.

8. The connector assembly according to claim 5, wherein said second shield shell is connected to a shield shell installed into said external connector.

* * * * *